US005542265A

United States Patent [19]

Rutland

[11] Patent Number: 5,542,265

[45] Date of Patent: Aug. 6, 1996

[54] EXTERNAL REFRIGERATOR-MOUNTED LIQUID DISPENSER

[76] Inventor: Michael D. Rutland, 1016 D Cabrillo Park Dr., Santa Ana, Calif. 92701

[21] Appl. No.: 497,289

[22] Filed: Jun. 30, 1995

[51] Int. Cl.[6] ..... B67D 5/62

[52] U.S. Cl. ..... 62/389; 62/338; 62/440; 222/146.6

[58] Field of Search ..... 62/338, 339, 389, 62/390, 391, 440; 222/146.6, 146.1

[56] References Cited

U.S. PATENT DOCUMENTS

| | | | |
|---|---|---|---|
| 2,751,757 | 6/1956 | Hobbs et al. | 62/338 |
| 2,982,114 | 5/1961 | Cobb et al. | 62/338 |
| 3,024,621 | 3/1962 | Parker | 62/339 |
| 3,429,140 | 2/1969 | White | 62/339 |
| 3,834,178 | 8/1974 | Pink | 62/338 |
| 4,739,629 | 4/1988 | True | 62/338 |
| 5,096,095 | 3/1992 | Burton | 62/338 |
| 5,269,154 | 12/1993 | Schmidt | 62/275 |

*Primary Examiner*—John M. Sollecito
*Attorney, Agent, or Firm*—Gene Scott

[57] ABSTRACT

A chilled liquid dispensing apparatus having a housing mounted to an exterior surface of a refrigerator. A liquid pumping means, a downwardly disposed dispensing tube and a pumping means actuation means are enclosed within the housing, and a liquid storage bottle is contained within the refrigerator. A suction line connects the

8 Claims, 3 Drawing Sheets

EXTERNAL REFRIGERATOR-MOUNTED LIQUID DISPENSER

BACKGROUND OF THE INVENTION

1. Field of the Invention

This invention relates generally to liquid dispensing devices, and more particularly to a liquid dispensing unit designed to be adhered to the exterior of a refrigerator so as to allow chilled liquid stored inside the refrigerator to be accessed from the exterior.

2. Description of Related Art

Invention and use of liquid dispensing devices is known to the public, as they are commonly used to provide convenient access to a variety of liquids, particularly water. There are numerous different types of water dispensing devices designed to fulfill a wide variety of different needs. In many office and residential settings, it is desirable to have a dispenser capable of dispensing chilled water. Free-standing dispensers with internal cooling systems have been invented to fulfill these needs. However, such dispensing devices are plagued with many problems. First of all, in order to contain an entire cooling system and be of a height for convenient access of the water, these devices generally have a relatively large, space-consuming configuration. In addition, such dispensers are generally designed to accept an inverted five-gallon water bottle. When full, these bottles are quite heavy, making it difficult or impossible for many people to lift and properly position full bottles.

Dispensing devices designed to be interconnected with a refrigerator significantly improve over these free-standing dispensers in that they require no extra space and no lifting of heavy water bottles. One example of such a device is seen in Pink U.S. Pat. No. 3,834,178. Pink discloses an unpressurized container for dispelling chilled water from a freezer-refrigerator or the like. The container is connected into a water supply line through a valve upstream of the container. The container itself consists of a pair of elongated tanks disposed one above the other and constructed so as to impede mixing of warm water entering the lower tank with chilled water in both tanks as the chilled water is drawn off through an outlet from the upper tank.

Schmidt U.S. Pat. No. 5,269,154 teaches a closure with an ice dispensing apparatus having an ice chute operatively associated with a discharge opening. The closure includes a door case having a front wall of a size and shape corresponding to the opening and a rearwardly turned perimeter wall connected to the front wall and having an outwardly turned flange. An insulation core is disposed within the perimeter wall rearwardly of the front wall. A gasket engages the opening incident to the closure being in the closed position. A resistance heater is positioned in the door case between the front wall and the insulation to prevent sweating of the closure. True U.S. Pat. No. 4,739,629, and White U.S. Pat. No. 3,429,140 also disclose similar water dispensing apparatus.

However, all of these devices, as disclosed, are designed only for implementation within a refrigerator, and, in fact, their construction and installation is so complex that they virtually must be built into a refrigerator upon construction. Therefor, these devices are of little practical value for those people who already own refrigerators that do not have built-in dispensers. Thus, several water dispensing devices have been invented that can be incorporated within a pre-existing refrigerator. For example, Parker U.S. Pat. No. 3,024,621 discloses a water cooling apparatus kit for supplying water to a storage container and dispenser within a refrigerator. A supply water tube is flattened where it passes the door. The device may be applied or installed within a conventional refrigerator in common use today without any modification of the refrigerator construction.

Cobb et al. U.S. Pat. No. 2,982,114 teaches a similar apparatus to that of Parker, but the water supply is conducted into the refrigerator through the rear wall. A novel constant level arrangement is used so that the storage tank does not need to be pressurized, to displace water in the tank through a standpipe, the level in the tank remaining the same before, during and after dispensing.

However, with both of these devices, the .door of the refrigerator must be open to access the water. This is undesirable, especially in frequent water use environments, as it is not convenient for the user and repeated opening of the refrigerator causes the temperature within the refrigerator to rise. An additional drawback of all prior art dispensing devices is that they are designed only for dispensing water, and cannot be used to dispense any other type of cold liquid.

Thus, there is a clear need for an improved dispensing device that can be easily attached to a pre-existing refrigerator. Such a device would allow external access to liquid stored within the refrigerator without necessitating that the refrigerator door be opened. Such a device would also be capable of dispensing several different liquids and would provide means to allow the user to choose which liquid is to be dispensed. The present invention fulfills these needs and provides further related advantages as described in the following summary.

SUMMARY OF THE INVENTION

The present invention is an improved liquid dispensing device designed to be quickly and easily attached to a refrigerator so as to allow chilled liquid stored inside the refrigerator to be conveniently accessed from the exterior of the refrigerator. Thus, it is a primary object of the present invention to enable those having refrigerators without built-in door dispensers to still quickly and conveniently access chilled liquid as needed without necessitating that the refrigerator door be opened, thereby saving both time and electricity.

The device consists generally of a receptacle, such as a bottle, positioned within the interior of the refrigerator and a housing mounted to an exterior surface of the refrigerator. A liquid pumping means, a downwardly disposed dispensing tube and a pumping means actuation means are enclosed within the housing. The housing is relatively lightweight, and is easily mounted to the refrigerator with a bracket, tape, VELCRO®, screws or the like. A suction line extends from the externally mounted housing to the bottle contained within the refrigerator. A small hole may be drilled through the door so that the suction line penetrates directly through the door, or, alternately, the suction line may extend around the door and to the bottle. Thus, it is an object of the present invention to provide an apparatus that is has relatively few working parts and is lightweight, thereby greatly reducing manufacturing costs. It is another object of the present invention to provide an apparatus that is extremely easy to properly secure to a refrigerator so that no special or costly installation is required.

It is also an object of the present invention to improve considerably over prior art dispensers that are built-in a refrigerator or freezer, as these devices are only capable of dispensing water. However, because the present inventive apparatus draws its liquid supply from a refillable, removable container, it is capable of dispensing any liquid desired.

Still further, it is an object of the present invention to have the capability of dispensing multiple liquids from multiple containers stored within the refrigerator. To accomplish this, a multiposition electrical selection means is simply mounted on an exterior surface of the housing, a multichannel valve in electrical communication with the selection means is positioned in the suction line and a plurality of fluid conduits are included in the suction line, each conduit terminating in a different one of the storage containers.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention, a chilled water dispensing apparatus. In such drawings.

DETAILED DESCRIPTION OF THE PREFERRED EMBODIMENT

Figure 1:
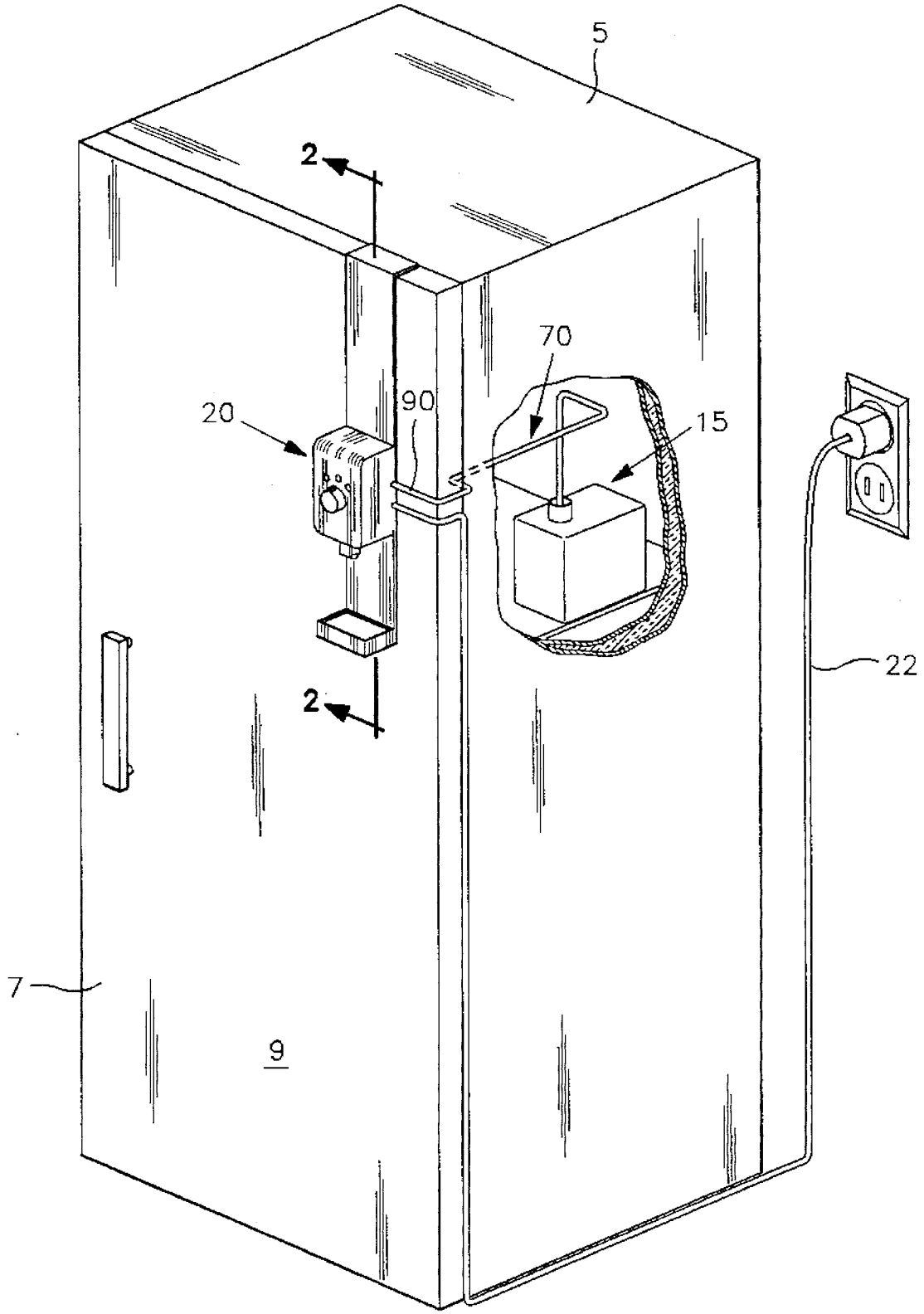
FIG. 1 is a perspective view of a preferred embodiment of the present invention, particularly showing the preferred positioning of a housing unit on an exterior surface of a refrigerator, a liquid storage bottle within the refrigerator and a suction line extending from the housing, around a door of the refrigerator and into the storage bottle.
Figure 2:
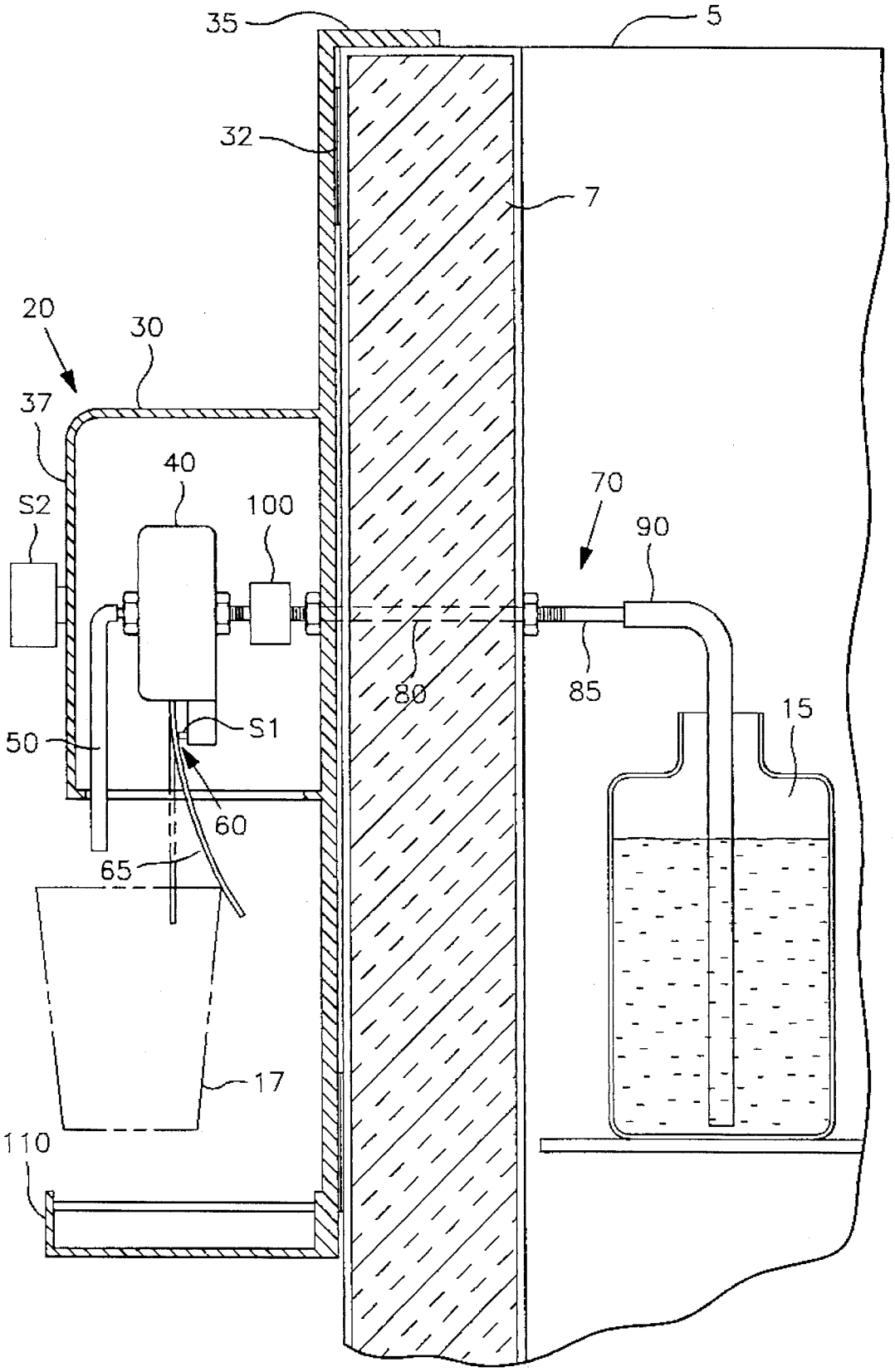
FIG. 2 is a cross-sectional view thereof taken along line 2—2 of FIG. 1, particularly showing the elements enclosed within the housing, and a suction line penetrating directly through the refrigerator door and to the water bottle.
Figure 3:
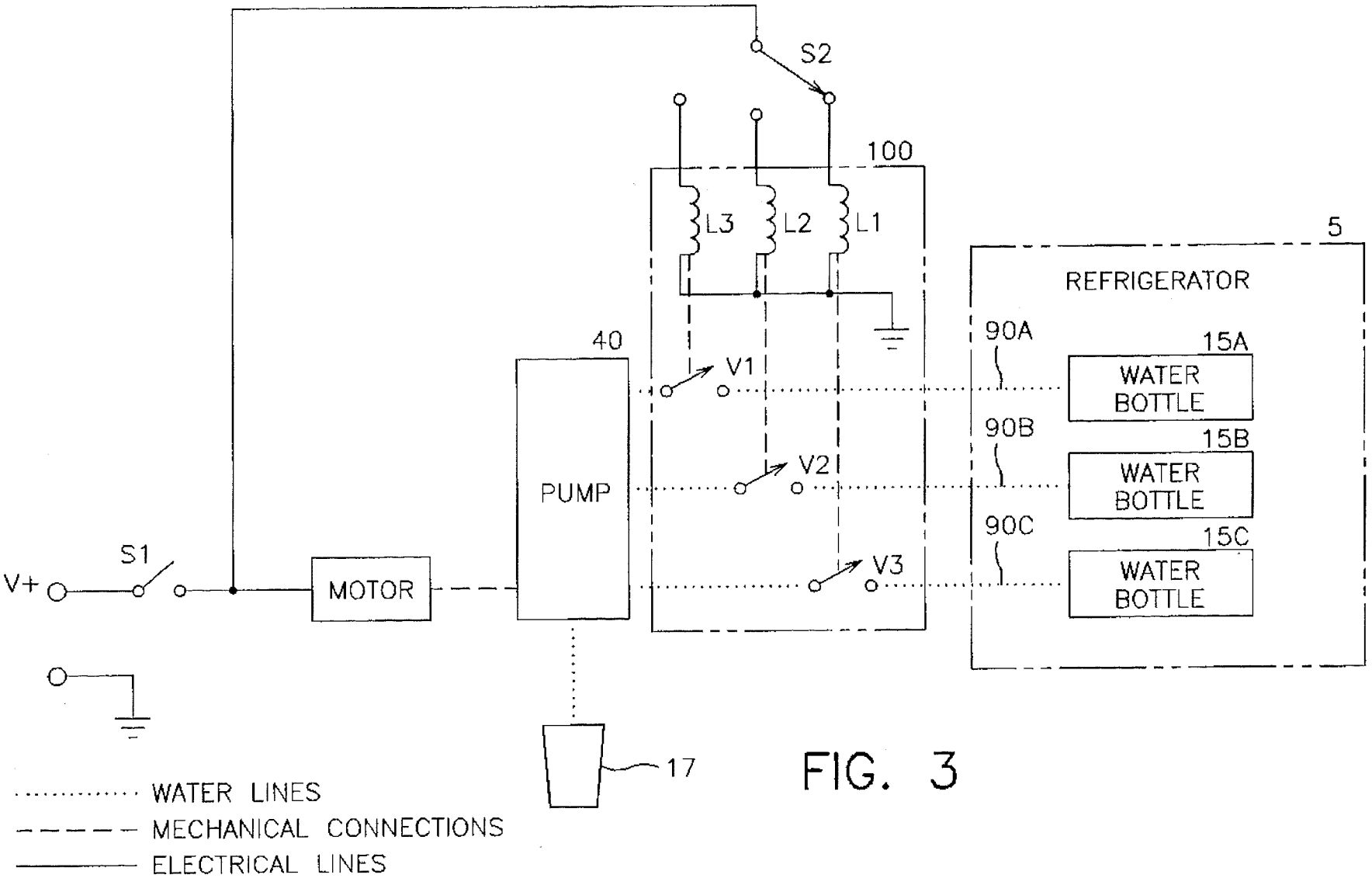
FIG. 3 is a schematic diagram, particularly showing the electrical and mechanical interconnections between the elements of the dispensing apparatus when it is designed to dispense multiple liquids from a plurality of liquid storage bottles.

FIGS. 1–3 show a chilled liquid dispensing apparatus designed for external attachment, either permanently, or removably, to the door, in a position adjacent to the door hinge, or to a side wall of a refrigerator 5. The apparatus is designed to provide quick and convenient access to chilled liquid stored within the refrigerator 5 without necessitating that a door 7 of the refrigerator 5 be opened.

The liquid dispensing apparatus includes a dispensing assembly 20 having a hollow housing 30 designed to be mounted to an exterior surface 9 of the refrigerator 5, preferably on the door 7. Double sided tape, a hook and loop fastening system, or any other such fastening means 32 may be used to conveniently mount the housing 30 to the exterior refrigerator surface 9 in an easily accessible location. Additionally, as illustrated in FIG. 2, an L-shaped bracket 35 may be secured to or formed integrally with the housing 30 for more secure mounting of the dispensing assembly 20. In this case the L-shaped bracket 35 is engaged on the top surface of the door as one possible embodiment. The dispensing apparatus may, of course, be fastened to the refrigerator in a more permanent manner by sheet metal screws or the like.

The elements of the dispensing assembly 20 are enclosed within the housing 30, and preferably include a pumping means 40, a downwardly disposed dispensing tube 50 as an extension of an outlet of the pumping means 40, and a pumping means actuation means 60. These elements may be powered by either an AC or DC electrical source. When an AC source is used, an electrical cord 22 extends from the housing to an electrical outlet in a manner that does not interfere with opening and closing of the door 7, as illustrated in FIG. 1. The pumping means actuation means 60 preferably consists of a flexible spring lever 65 of a spring material such as beryllium-copper or spring steel, positioned directly in front of and parallel to an activation switch S1, the lever 65 is designed to flex into contact with the switch S1 when it is pushed in that direction. However, since the elements of the dispensing assembly 20 are all common components of standard liquid pumping and/or dispensing devices, the exact nature of these elements may be any of a wide range of such elements as well known in the art.

A suction line 70 is partially contained within and extends from the externally mounted housing 3 0 to a storage bottle 15 contained within the refrigerator 5, the suction line 70 thus supplying the dispensing assembly 20 with a constant liquid supply. The suction line 70 preferably includes both a nipple means 80 and a flexible suction hose means 90. There are numerous different configurations of the nipple means 80 and the flexible suction hose means 90 that may be successfully implemented within the scope of the present invention. In one preferred embodiment, illustrated in FIG. 1, the suction hose means 90 and the suction nipple means 80 are interconnected within the housing 30, and the suction hose means 90 is routed from the housing 30, around the refrigerator door 7, into the interior of the refrigerator 5 and thence into the liquid storage bottle 15. Refrigerators generally have a thick rubber gasket around the opening in the refrigerator box where the door is received and which seals the door thereon. It has been found that it is possible to route a liquid carrying tube between this gasket and the door without causing an air leak into the refrigerator and without crushing the tube. Alternately, as shown in FIG. 2, a small hole may be drilled through the refrigerator door 7, or alternately, a side wall, so that the suction nipple means 80 penetrates the door 7 or the side wall, and a nipple portion 85 extends into the interior of the refrigerator 5. In this embodiment, the suction hose means 90 interconnects with the nipple portion 85 and is routed into the liquid storage bottle 15.

If desired, the liquid dispensing apparatus may be constructed with the capability of dispensing more than one liquid. In this embodiment, multiple liquid storage bottles 15A, 15B and 15C are positioned within the refrigerator 5, and a multiposition selection means S2, such as an electrical rotary switch, is integral with or mounted to an exterior surface 37 of the housing 30, each position of the selection means S2 corresponding to a different one of the storage bottles 15A, 15B and 15C. A multichannel valve 100, positioned in the suction line 70, is in electrical communication with the multiposition selection means S2 so as to allow liquid to be drawn from the selected storage bottle. As illustrated in FIG. 3, the multichannel valve 100 consists of, in one preferred embodiment, three separate solenoid activated valves, or, alternately it may consist of a single compound valve. The suction hose means 90 consists of a plurality of fluid conduits 90A, 90B and 90C that extend from the suction nipple means 80 into each different one of the storage bottles 15A, 15B and 15C.

Preferably, the nipple means 80 is a coaxial or side-by-side arrangement of a plurality of passageways, each passageway receiving liquid from one of the fluid conduits 90A-C. The nipple means 80 extends from the housing 30, either around or through the door 7, and is interconnected with the suction hose means 90 so that each passageway receives liquid from one of the fluid conduits. In another embodiment, the nipple means 80 terminates within the housing 30 and the multiple fluid conduits 90A–C extend from the nipple means 80, around or through the refrigerator door 7 and to their respective storage bottles 15A–C. In yet another embodiment, a plurality of individual dispensing assemblies 20 may be enclosed within a single housing unit 30, each assembly providing a separate pumping means actuation means 60, thus allowing multiple liquids to be dispensed simultaneously.

To use the present inventive liquid dispensing apparatus, the housing unit 30 is first mounted to the exterior surface 9 of the refrigerator 5. The desired number of storage bottles 15A–C are positioned at any desired location within the refrigerator 5, and separate fluid conduits 90A–C are placed in each bottle, one per bottle. As illustrated in FIG. 2, the liquid storage bottles 15A–C must not be completely sealed, as the dispensed liquid must be replaced by air so as to prevent the bottles from collapsing. When it is desired to access liquid from one of the bottles, a user simply rotates the multiposition electrical selection means S2 to select the desired liquid, positions a drinking glass 17 or the like under the dispensing tube 50 and presses it against the lever 65 of the actuation means 60. The lever 65 flexes into contact with the actuation switch S1, which is preferably a simple and inexpensive microswitch, thus energizing the pumping means 40 to begin pumping. The electrical selection means S2 actuates the multichannel valve 100 to allow liquid to be pumped only from the selected bottle. Preferably, a trough 110 is positioned below the dispensing tube 50 for collecting liquid drips and spills. The trough 110 is spaced apart from the dispensing tube 50 at a distance greater then the height of a standard drinking glass 17. The trough 110 may be formed integrally with the housing 30, as illustrated, or it may be formed as a separate, removable unit.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A chilled liquid dispensing apparatus for use with a refrigerator and a drinking glass, the apparatus comprising:

A dispensing assembly including a hollow housing adapted for mounting to an exterior surface of the refrigerator, the housing enclosing a liquid pumping means, a downwardly disposed dispensing tube and a pumping means actuation means; and a suction line, the suction line including a nipple means and a flexible suction hose means, the apparatus further including a trough positioned below the dispensing tube and spaced apart therefrom, positioned for collecting liquid drips from the dispensing tube, the suction line terminating within at least one liquid storage bottle within the refrigerator, the actuation means positioned for engagement with the drinking glass when said glass is under the dispensing tube to energize the pumping means for pumping a liquid from the storage bottle to the glass.

2. The apparatus of claim 1 wherein the suction hose means interconnects with the suction nipple means within the housing and is routed therefrom, around a door of the refrigerator and thence, into the interior of the refrigerator and terminated within the at least one storage bottle.

3. The apparatus of claim 2 wherein the suction line includes a plurality of fluid conduits, and further including a multiposition electrical selection means mounted on an exterior surface of the housing electrically interconnected so as to actuate a multichannel valve positioned in the suction line to select one of the fluid conduits.

4. The apparatus of claim 1 wherein the suction nipple means penetrates a door of the refrigerator with a nipple portion extending into the interior of the refrigerator, the suction hose means interconnecting therewith and further routed from the nipple portion to the at least one storage bottle within the refrigerator.

5. The apparatus of claim 1 wherein the dispensing assembly includes an upwardly extending L-shaped hanger bracket configured to engage the refrigerator.

6. The apparatus of claim 1 wherein the dispensing assembly includes a fastening means for engaging the dispensing assembly with the refrigerator.

7. The apparatus of claim 1 wherein the fastening means is double sided adhesive tape.

8. The apparatus of claim 1 wherein the fastening means is a hook and loop fastening system.

* * * * *